US010260134B2

(12) United States Patent
Hamada et al.

(10) Patent No.: US 10,260,134 B2
(45) Date of Patent: Apr. 16, 2019

(54) HOT ROLLED FERRITIC STAINLESS STEEL SHEET FOR COLD ROLLING RAW MATERIAL

(71) Applicant: Nippon Steel & Sumikin Stainless Steel Corporation, Tokyo (JP)

(72) Inventors: Junichi Hamada, Hikari (JP); Yuji Koyama, Kita-kyushu (JP); Yoshiharu Inoue, Kita-kyushu (JP); Tadashi Komori, Hikari (JP); Fumio Fudanoki, Nagoya (JP); Toshio Tanoue, Yokohama (JP); Naoto Ono, Nagoya (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 0 days.

(21) Appl. No.: 14/969,310

(22) Filed: Dec. 15, 2015

(65) Prior Publication Data

US 2016/0097114 A1 Apr. 7, 2016

Related U.S. Application Data

(62) Division of application No. 14/383,434, filed as application No. PCT/JP2013/058856 on Mar. 26, 2013.

(30) Foreign Application Priority Data

Mar. 30, 2012 (JP) ..... 2012-081998

(51) Int. Cl.

| | |
|---|---|
| ***C22C 38/54*** | (2006.01) |
| ***C21D 9/46*** | (2006.01) |
| ***C22C 38/32*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/40*** | (2006.01) |
| ***C22C 38/44*** | (2006.01) |
| ***C22C 38/48*** | (2006.01) |
| ***C22C 38/50*** | (2006.01) |
| ***C21D 8/02*** | (2006.01) |

(Continued)

(52) U.S. Cl.

CPC ..... *C22C 38/54* (2013.01); *C21D 6/002* (2013.01); *C21D 7/02* (2013.01); *C21D 7/13* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C22C 38/40* (2013.01); *C22C 38/42* (2013.01); *C22C 38/44* (2013.01); *C22C 38/48* (2013.01); *C22C 38/50* (2013.01); *C22C 38/52* (2013.01); *C21D 2201/05* (2013.01); *C21D 2211/005* (2013.01)

(58) Field of Classification Search

CPC ..... C22C 38/54; C22C 38/52; C22C 38/50; C22C 38/48; C22C 38/44; C22C 38/42

See application file for complete search history.

(56) References Cited

U.S. PATENT DOCUMENTS

| | | | |
|---|---|---|---|
| 6,426,039 | B2 | 7/2002 | Hirasawa et al. |
| 9,243,306 | B2 | 1/2016 | Kanno et al. |

(Continued)

FOREIGN PATENT DOCUMENTS

| | | | |
|---|---|---|---|
| CN | 1786102 | A | 6/2006 |
| CN | 101435054 | A | 5/2009 |

(Continued)

OTHER PUBLICATIONS

Chinese Office Action and Search Report, dated Jul. 27, 2015, for Chinese Application No. 201380006138.6 with an English translation.

(Continued)

*Primary Examiner* — Edward M Johnson

(74) *Attorney, Agent, or Firm* — Birch, Stewart, Kolasch & Birch, LLP

(57) ABSTRACT

A heat-resistant cold rolled ferritic stainless steel sheet containing, in mass %, 0.02% or less of C, 0.1% to 1.0% of Si, greater than 0.6% to 1.5% of Mn, 0.01% to 0.05% of P, 0.0001% to 0.0100% of S, 13.0% to 20.0% of Cr, 0.1% to 3.0% of Mo, 0.005% to 0.20% of Ti, 0.3% to 1.0% of Nb, 0.0002% to 0.0050% of B, 0.005% to 0.50% of Al, 0.02% or less of N, with the balance being Fe and inevitable impurities, in which {111}-oriented grains are present at an area ratio of 20% or greater in a region from a surface layer to t/4 (t is a sheet thickness), {111}-oriented grains are present at an area ratio of 40% or greater in a region from t/4 to t/2, and {011}-oriented grains are present at an area ratio of 15% or less in the entire region in a thickness direction.

2 Claims, 2 Drawing Sheets

(51) Int. Cl.

| | |
|---|---|
| ***C22C 38/42*** | (2006.01) |
| ***C22C 38/52*** | (2006.01) |
| ***C21D 7/02*** | (2006.01) |
| ***C21D 7/13*** | (2006.01) |

(56) References Cited

U.S. PATENT DOCUMENTS

| | | | | |
|---|---|---|---|---|
| 2001/0003293 | A1 | 6/2001 | Hirata et al. | |
| 2002/0012602 | A1 | 1/2002 | Takahashi et al. | |
| 2002/0144756 | A1 | 10/2002 | Hirata et al. | |
| 2005/0161133 | A1 | 7/2005 | Hamada et al. | |
| 2005/0173033 | A1 | 8/2005 | Yazawa et al. | |
| 2009/0000703 | A1 | 1/2009 | Hamada et al. | |
| 2009/0092513 | A1 | 4/2009 | Hamada et al. | |
| 2009/0120536 | A1 | 5/2009 | Tomita et al. | |
| 2011/0061777 | A1 | 3/2011 | Ishii et al. | |
| 2011/0110812 | A1* | 5/2011 | Hiraide et al. | 420/41 |
| 2013/0004360 | A1 | 1/2013 | Kanno et al. | |
| 2013/0017116 | A1 | 1/2013 | Hatano et al. | |
| 2013/0129560 | A1 | 5/2013 | Matsuhashi et al. | |

FOREIGN PATENT DOCUMENTS

| | | | | |
|---|---|---|---|---|
| CN | 101454471 | A | | 6/2009 |
| CN | 101784686 | A | | 7/2010 |
| EP | 0478790 | A1 | | 4/1992 |
| EP | 1930461 | A1 | | 6/2008 |
| EP | 2112245 | A1 | | 10/2009 |
| JP | 63-162818 | A | | 7/1988 |
| JP | 3-274245 | A | | 12/1991 |
| JP | 5-33104 | A | | 2/1993 |
| JP | 8-199235 | A | | 8/1996 |
| JP | 9-263900 | A | | 10/1997 |
| JP | 9-279312 | A | | 10/1997 |
| JP | 2696584 | B2 | | 1/1998 |
| JP | 2000-178693 | A | | 6/2000 |
| JP | 2001-181808 | A | | 7/2001 |
| JP | 2001-294991 | A | | 10/2001 |
| JP | 2002-30346 | A | | 1/2002 |
| JP | 2003-155543 | A | | 5/2003 |
| JP | 2004-218013 | A | | 8/2004 |
| JP | 2006-233278 | A | | 9/2006 |
| JP | 2006-328525 | A | | 12/2006 |
| JP | 2008-138270 | A | | 6/2008 |
| JP | 2008190003 | A | * | 8/2008 |
| JP | 2008-291282 | A | | 12/2008 |
| JP | 2009-1834 | A | | 1/2009 |
| JP | 2009-102728 | A | | 5/2009 |
| JP | 2009-120894 | A | | 6/2009 |
| JP | 2009-197306 | A | | 9/2009 |
| JP | 2009-197307 | A | | 9/2009 |
| JP | 2009-215648 | A | | 9/2009 |
| JP | 2009-235555 | A | | 10/2009 |
| JP | 2010-156059 | A | | 7/2010 |
| JP | 2011-68948 | A | | 4/2011 |
| JP | 2011-179116 | A | | 9/2011 |
| JP | 2011-190468 | A | | 9/2011 |
| JP | 2011179114 | A | * | 9/2011 |
| JP | 2011190524 | A | * | 9/2011 |
| JP | 2012-193435 | A | | 10/2012 |
| KR | 2001-0062057 | A | | 7/2001 |
| WO | WO 2004/053171 | A1 | | 6/2004 |
| WO | WO 2011/096454 | A1 | | 8/2011 |
| WO | WO 2011/111871 | A1 | | 9/2011 |
| WO | WO 2011/122513 | A1 | | 10/2011 |
| WO | WO 2012/018074 | A1 | | 2/2012 |

OTHER PUBLICATIONS

International Search Report issued in PCT/JP2013/058856, dated Jun. 11, 2013.

Korean Office Action for Korean Application No. 10-2014-7023338, dated Aug. 17, 2015, with a partial English translation.

PCT/ISA/237 issued in PCT/JP2013/058856, dated Jun. 11, 2013.

Restriction Requirement dated Oct. 9, 2015, issued in U.S. Appl. No. 14/383,434.

U.S. Office Action, dated Jan. 7, 2016, for U.S. Appl. No. 14/383,434.

Canadian Office Action for Canadian Application No. 2,866,136, dated Feb. 12, 2016.

International Search Report for International Application No. PCT/JP2013/056531, dated May 28, 2013.

Kato et al., "Development of a Ferritic Stainless Steel with Excellent Heat Resistance," Transactions of the Society of Automotive Engineers of Japan, vol. 39, No. 2, Mar. 25, 2008, pp. 329-333, including an English Abstract.

U.S. Office Action for U.S. Appl. No. 14/384,121, dated Mar. 2, 2017 (Non-Final Rejection).

U.S. Office Action for U.S. Appl. No. 14/383,434, dated Sep. 29, 2017 (Non-Final Rejection).

U.S. Office Action dated Mar. 20, 2018 for U.S. Appl. No. 14/383,434.

U.S. Advisory Action, dated Dec. 13, 2018, for U.S. Appl. No. 14/383,434.

U.S. Office Action for U.S. Appl. No. 15/726,722, dated Oct. 19, 2018.

U.S. Office Action dated Jan. 30, 2019, issued in U.S. Appl. No. 14/383,434.

* cited by examiner

HOT ROLLED FERRITIC STAINLESS STEEL SHEET FOR COLD ROLLING RAW MATERIAL

This application is a Divisional of application Ser. No. 14/383,434, filed Sep. 5, 2014, which is the National Stage Entry of PCT International Application No. PCT/JP2013/058856, filed on Mar. 26, 2013, which claims priority under 35 U.S.C. 119(a) to Japanese Patent Application No. 2012-081998, filed on Mar. 30, 2012, all of which are hereby expressly incorporated by reference into the present application.

TECHNICAL FIELD

The present invention relates to a heat-resistant cold rolled ferritic stainless steel sheet which is appropriate for use especially in exhaust system members of vehicles and the like requiring a high temperature strength and oxidation resistance and has excellent workability, a hot rolled ferritic stainless steel sheet for a material for cold rolling (cold rolling raw material), and methods for producing the same.

The present application claims priority on Japanese Patent Application No. 2012-081998 filed on Mar. 30, 2012, the content of which is incorporated herein by reference.

BACKGROUND ART

Heat-resistant steel containing Cr is used in exhaust system members such as exhaust manifolds and mufflers of vehicles, since the members require a high temperature strength and oxidation resistance. Since these exhaust system members may be manufactured through press working from a steel sheet or through various formings after pipe working of a steel sheet, cold rolled steel sheets as a raw material are required to have formability.

With an increase in the temperature of exhaust gas, the operating temperature of the members is also increased every year, and it is necessary to increase the high temperature strength and the like by increasing the added amounts of alloys such as Cr, Mo, and Nb. However, in the case where the amounts of added elements are increased, the workability of a raw material steel sheet is decreased in a simple manufacturing method, and thus press forming may not be performed on members having a complicated shape.

In order to improve the Lankford value (r-value) which is an index of workability of ferritic stainless steel sheets, it is effective to increase a cold rolling reduction ratio. However, since a relatively thick cold rolled steel sheet (approximately 1.5 mm to 2.5 mm) is used as a raw material for the above-described exhaust system members, there is a problem in that a sufficient cold rolling reduction ratio cannot be secured in the current manufacturing process in which the raw material thickness is regulated to a certain degree when performing cold rolling.

In order to solve this problem, a component and a manufacturing method have been devised for improving an r-value which is an index of press formability without deteriorating high temperature characteristics, Patent Document 1 discloses component adjustment to improve workability of conventional heat-resistant ferritic stainless steel sheets, but with this, a problem occurs such as press cracking in thick materials having a relatively low cold rolling reduction ratio.

In Patent Document 2, in order to improve the r-value, the most appropriate annealing temperature of a hot rolled sheet is specified based on a relationship of an annealing temperature of a hot rolled sheet to a hot finish rolling start temperature, a hot finish rolling end temperature, and an Nb content. However, with this, sufficient workability may not be obtained according to influences of other elements (C, N, Cr, Mo, and the like) involved especially in Nb-based precipitates.

Patent Document 3 discloses a method of subjecting a hot rolled sheet to aging for 1 hour or longer, but in this case, there is a disadvantage in that the industrial manufacturing efficiency is greatly reduced.

Patent Document 4 discloses a technology for obtaining a Cr-containing heat-resistant steel sheet having a high r-value in which conditions for hot rolling and annealing of a hot rolled sheet are specified to control the crystal orientation of a center layer in a sheet thickness direction. However, since the r-value is not determined only with the crystal orientation of the center layer in a sheet thickness direction of the product, sufficient workability may not be obtained. In addition, since a heating temperature of a slab in hot rolling is in a range of 1,000° C. to 1,150° C. which is low, there is a problem such as surface scratches.

Patent Document 5 discloses a technology of specifying the crystal orientation in a region from an outermost layer to a depth of one quarter of a sheet thickness in a ferritic stainless steel sheet for an exhaust component having excellent workability. This technique increases the r-value and total elongation in a direction at an angle of 45° with respect to a rolling direction, and the technique is characterized in that annealing of a hot rolled sheet is omitted in the manufacturing method. However, in the case where only the r-value in the direction at an angle of 45° is increased, press formability is not satisfied, and in the case where annealing of a hot rolled sheet is omitted, surface defects which are called ridging cause a problem in press working and there is a problem in manufacturability such as surface scratches.

PRIOR ART DOCUMENTS

Patent Documents

Patent Document 1: Japanese Unexamined Patent Application, First Publication No. H9-279312

Patent Document 2: Japanese Unexamined Patent Application, First Publication No. 2002-30346

Patent Document 3: Japanese Unexamined Patent Application, First Publication No. H8-199235

Patent Document 4: PCT International Publication No. WO2004/53171

Patent Document 5: Japanese Unexamined Patent Application, First Publication No. 2006-233278

DISCLOSURE OF THE INVENTION

Problems to be Solved by the Invention

An object of the invention is to solve problems of known technologies and to provide a heat-resistant cold rolled ferritic stainless steel sheet which has excellent workability, a hot rolled ferritic stainless steel sheet for a material for cold rolling, and methods for producing the same.

Means for Solving the Problems

In order to solve the problems, the inventors of the invention have conducted an intensive study on steel composition and on structures and precipitates in manufacturing processes, i.e., a hot rolling process and a cold rolling process with regard to an improvement in workability of a heat-resistant cold rolled ferritic stainless steel sheet, especially in r-value.

The features of the invention for solving the problems are as follows.

According to a first aspect of the invention, there is provided a heat-resistant cold rolled ferritic stainless steel sheet containing, in terms of mass %, 0.02% or less of C, 0.1% to 1.0% of Si, greater than 0.6% to 1.5% of Mn, 0.01% to 0.05% of P, 0.0001% to 0.0100% of S, 13.0% to 20.0% of Cr, 0.1% to 3.0% of Mo, 0.005% to 0.20% of Ti, 0.30% to 1.0% of Nb, 0.0002% to 0.0050% of B, 0.005% to 0.50% of Al, and 0.02% or less of N, with the balance being Fe and inevitable impurities, wherein when a sheet thickness is represented by t, {111}-oriented grains are present at an area ratio of 20% or greater in a region from a surface layer to t/4, {111}-oriented grains are present at an area ratio of 40% or greater in a region from t/4 to t/2, and {011}-oriented grains are present at an area ratio of 15% or less in the entire region in a thickness direction.

The cold rolled stainless steel sheet has excellent workability. In the first aspect, the region from the surface layer to t/4 is a region ranging from the surface of the steel sheet to a depth of t/4, and the region from t/4 to t/2 is a region ranging from a depth of t/4 to the center in the sheet thickness direction.

According to a second aspect of the invention, there is provided the heat-resistant cold rolled ferritic stainless steel sheet according to the first aspect, which further contains, in terms of mass %, one or more selected from 0.4% to 2.0% of Cu, 0.1% to 2.0% of Ni, 0.1% to 3.0% of W, 0.05% to 0.30% of Zr, 0.05% to 0.50% of Sn, 0.05% to 0.50% of Co, and 0.0002% to 0.0100% of Mg.

According to a third aspect of the invention, there is provided a hot rolled ferritic stainless steel sheet for a material for cold rolling for manufacturing the heat-resistant cold rolled ferritic stainless steel sheet according to the first or second aspect, wherein when a sheet thickness is represented by t', a microstructure in a region from t'/2 to t'/4 is a non-recrystallized microstructure.

The region from t'/2 to t'/4 is a region ranging from a depth of t'/4 to the center in the sheet thickness direction. The hot rolled ferritic stainless steel sheet according to the third aspect has substantially the same composition as the heat-resistant cold rolled ferritic stainless steel sheet according to the first or second aspect.

According to a fourth aspect of the invention, there is provided a method for producing the hot rolled ferritic steel sheet for a material for cold rolling according to the third aspect, including: performing hot rolling under conditions where a heating temperature of a slab (semi-finished product) is set to be in a range of 1200° C. to 1300° C. and a finishing temperature is set to be in a range of 800° C. to 950° C. so as to form a hot rolled sheet; coiling the hot rolled sheet at a coiling temperature of 500° C. or lower; and then annealing the hot rolled sheet at a temperature of 925° C. to 1000° C.

In the fourth aspect, as the slab which is a raw material of the steel sheet, a slab having substantially the same composition as the steel sheet according to the first or second aspect is used.

According to a fifth aspect of the invention, there is provided a method for producing the heat-resistant cold rolled ferritic stainless steel sheet according to the first or second aspect, including: subjecting a hot rolled ferritic steel sheet for a material for cold rolling in which when a sheet thickness is represented by t', a microstructure in a region from t'/2 to t'/4 is a non-recrystallized microstructure to cold rolling at a rolling reduction ratio of 60% or greater so as to form a cold rolled sheet; and then annealing the cold rolled sheet at a temperature of 1000° C. to 1100° C.

In the fifth aspect, as the hot rolled steel sheet which is a raw material of the cold rolled steel sheet, a steel sheet having substantially the same composition as the cold rolled steel sheet according to the first or second aspect is used.

The method for producing the heat-resistant cold rolled ferritic stainless steel sheet may include a process of manufacturing the hot rolled ferritic steel sheet for a material for cold rolling. That is, according to a sixth aspect of the invention, there is provided the method for producing the heat-resistant cold rolled ferritic stainless steel sheet according to the fifth aspect, including: performing hot rolling under conditions where a heating temperature of a slab is set to be in a range of 1200° C. to 1300° C. and a finishing temperature is set to be in a range of 800° C. to 950° C. so as to form a hot rolled sheet; coiling the hot rolled sheet at a coiling temperature of 500° C. or lower, and then annealing the hot rolled sheet at a temperature of 925° C. to 1000° C. so as to produce the hot rolled ferritic steel sheet for a material for cold rolling. In that case, as the slab which is a raw material of the steel sheet, a slab having substantially the same composition as the steel sheet according to the first or second aspect is used.

Effects of the Invention

As described above, according to the invention, in a heat-resistant cold rolled ferritic stainless steel sheet, it is possible to secure a high r-value by specifying a component composition of steel together with optimizing conditions of a hot rolling process and a cold rolling process, and controlling microstructures of respective regions in a sheet thickness direction.

Particularly, when a coiling temperature and an annealing temperature of a hot rolled sheet are strictly specified in the hot rolling process, and the steel microstructure before the cold rolling process is set to be a non-recrystallized microstructure in which recrystallization is suppressed together with a {111} texture allowed to remain, a lot of crystal grains having a {111} direction which effectively act for an improvement in the r-value can be generated in the subsequent cold rolling and annealing processes; and thereby, a recrystallized microstructure which is advantageous for workability can be obtained.

EMBODIMENTS OF THE INVENTION

Cold Rolled Ferritic Stainless Steel Sheet

Figure 1:
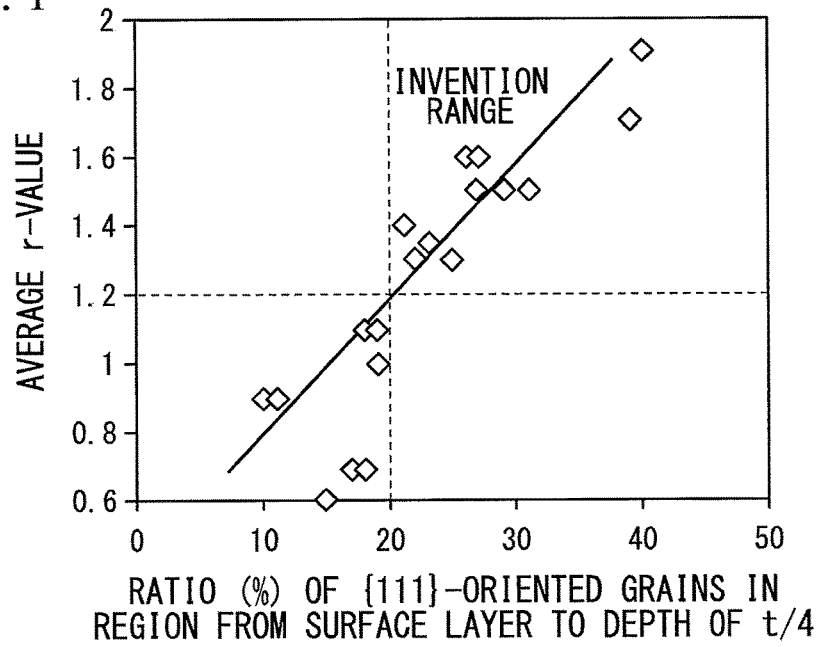
FIG. 1 is a graph showing a relationship between an area ratio of {111}-oriented grains in a region from a surface layer to t/4 (t: sheet thickness) and an average r-value in a cold rolled ferritic stainless steel sheet of an embodiment.

Hereinafter, a cold rolled ferritic stainless steel sheet of an embodiment will be described in detail.

A cold rolled ferritic stainless steel sheet of this embodiment contains, in terms of mass %, 0.02% or less of C, 0.1% to 1.0% of Si, greater than 0.6% to 1.5% of Mn, 0.01% to 0.05% of P, 0.0001% to 0.0100% of S, 13.0% to 20.0% of Cr, 0.1% to 3.0% of Mo, 0.005% to 0.20% of Ti, 0.30% to 1.0% of Nb, 0.0002% to 0.0050% of B, 0.005% to 0.50% of Al, and 0.02% or less of N, with the balance being Fe and inevitable impurities. When a sheet thickness is represented by t, crystal grains having a {111} orientation are present at an area ratio of 20% or greater in a region from a surface layer to t/4, crystal grains having a {111} orientation are present at an area ratio of 40% or greater in a region from t/4 to t/2, and crystal grains having a {011} orientation are present at an area ratio of 15% or less in the entire region in a thickness direction.

Here, the region from the surface layer to t/4 is a region ranging from the surface of the steel sheet to a depth of t/4, and the region from t/4 to t/2 is a region ranging from a depth of t/4 to the center in the sheet thickness direction.

The crystal grains having a {111} orientation ({111}-oriented grains) are crystal grains in which the sheet surface (the surface of the steel sheet) and the {111} plane are in parallel. The crystal grains having a {011} orientation ({011}-oriented grains) are crystal grains in which the sheet surface and the {011} plane are in parallel. The area ratio can be indicated as an area ratio of {111}-oriented grains and as an area ratio of {011}-oriented grains in a plane which is perpendicular to the sheet surface and in parallel to a rolling direction. The area ratio can be obtained by, for example, measuring a crystal orientation distribution in a cross-section of the steel sheet through an electron backscatter diffraction image method.

Hereinafter, the reasons for restricting the steel composition of the cold rolled ferritic stainless steel sheet of the invention will be described. Unless specifically noted, the symbol % means mass % in association with the composition.

Carbon (C): 0.02% or Less in Terms of Mass %

C deteriorates workability, corrosion resistance, and oxidation resistance. Therefore, the smaller the content thereof is, the better it is. Accordingly, the upper limit is set to 0.02%. However, since an excessive reduction leads to an increase in refining costs, the lower limit is preferably set to 0.001%. The content of C is desirably in a range of 0.002% to 0.01% in consideration of manufacturing costs and corrosion resistance.

Silicon (Si): 0.1% to 1.0% in Terms of Mass %

Si may be added as a deoxidation element and is an element which improves oxidation resistance and high temperature strength of steel. In addition, Si is an element which promotes precipitation of Laves phases. Accordingly, the addition thereof in an amount of 0.1% or greater causes precipitation of coarse Laves phases during annealing of a hot rolled sheet, and contributes to the development of {111}-oriented grains and the suppression of {011}-oriented grains during annealing of a cold rolled sheet and an improvement in the r-value. Since an excessive addition reduces room temperature ductility and thus deteriorates workability, the upper limit is set to 1.0%. The content of Si is desirably in a range of 0.2% to 0.5% in consideration of material quality and oxidation characteristics.

Manganese (Mn): Greater than 0.6% to 1.5% in Terms of Mass %

Mn forms $MnCr_2O_4$ and MnO at a high temperature, and Mn improves scale adhesion. Since these effects are exhibited in the case where the amount of Mn is greater than 0.6%, the lower limit is set to be in a range of greater than 0.6%. Meanwhile, since a mass gain due to oxidation is increased, breakaway (abnormal oxidation) easily occurs in the case where Mn is added in an amount of greater than 1.5%. In exhaust gas components such as exhaust manifolds, in the case where scale peeling and breakaway occur, problems may occur in subsequent components such as a catalyst, a muffler, or reliability of a structure may be reduced due to a reduction in the sheet thickness. Furthermore, the content of Mn is desirably in a range of 0.7% to 1.1% in consideration of workability and manufacturability.

Phosphorus (P): 0.01% to 0.05% in Terms of Mass %

P is a solid solution strengthening element as is the case with Si, but P is an element which is harmful to corrosion resistance and toughness of steel. Accordingly, the smaller the content thereof is, the better it is in view of material quality. Thus, the upper limit is set to 0.05%. However, since an excessive reduction leads to an increase in refining costs, the lower limit is set to 0.01%. The content of P is desirably in a range of 0.015% to 0.025% in consideration of manufacturing costs and oxidation resistance.

Sulfur (S): 0.0001% to 0.0100% in Terms of Mass %

The smaller the amount of S is, the better it is from the viewpoint of material quality, corrosion resistance, and oxidation resistance. Accordingly, the upper limit is set to 0.0100%. Particularly, an excessive addition of S leads to generation of a compound with Ti, and thus recrystallization and grain growth of the hot rolled and annealed sheet are promoted. Thus, non-recrystallized microstructure cannot be secured in the hot rolled steel sheet; and as a result, the r-value is deteriorated. However, since an excessive reduction leads to an increase in refining costs, the lower limit is set to 0.0001%. The content of S is desirably in a range of 0.0010% to 0.0050% in consideration of manufacturing costs and corrosion resistance.

Chromium (Cr): 13.0% to 20.0% in Terms of Mass %

Cr is required to be added in an amount of 13% or greater in order to improve a high temperature strength and oxidation resistance. However, in the case where Cr is added in an amount of 20% or greater, the manufacturability of the steel sheet deteriorates due to a deterioration in toughness, and the material quality also deteriorates. Accordingly, the amount of Cr is set to be in the range of 13.0% to 20.0%. The content of Cr is desirably in a range of 15.0% to 19.0% from the viewpoint of costs and corrosion resistance.

Molybdenum (Mo): 0.1% to 3.0% in Terms of Mass %

Mo improves corrosion resistance, and also leads to an improvement in high temperature strength and thermal fatigue characteristics of steel by a solid-solubilized Mo. Since these effects are exhibited in the case where the amount of Mo is in a range of 0.1% or greater, the lower limit is set to 0.1%. However, an excessive addition leads to a deterioration in toughness and a reduction in elongation. In addition, too many Laves phases are generated in the annealing process of a hot rolled sheet and in the annealing process of a cold rolled sheet, and thus {011}-oriented grains are easily generated and the r-value is reduced. Moreover, since oxidation resistance deteriorates in the case where Mo is added in an amount greater than 3.0%, the upper limit is set to 3.0%. The content of Mo is desirably in a range of 1.5% to 1.8% in consideration of high temperature characteristics after exposure to a high temperature for a long period of time, especially, a high temperature strength, thermal fatigue characteristics, and high-temperature and high-cycle fatigue characteristics and in consideration of manufacturing costs and manufacturability.

Titanium (Ti): 0.005% to 0.20% in Terms of Mass %

Ti is an element which is added to further improve corrosion resistance, intergranular corrosion resistance, and deep drawability by bonding to C, N, and S. Particularly, since development of {111} crystal orientation which improves the r-value is exhibited in the case where Ti is added in an amount of 0.005% or greater, the lower limit is set to 0.005%. Since toughness and secondary workability deteriorate in the case where Ti is added in an amount of 0.20% or greater, the upper limit is set to 0.2%. The content of Ti is desirably in a range of 0.06% to 0.15% in consideration of manufacturing costs, surface scratches, and scale spallability.

Niobium (Nb): 0.30% to 1.0% in Terms of Mass %

Nb improves a high temperature strength and high temperature fatigue characteristics due to solid solution strengthening and precipitation strengthening, and thus Nb is an essential element. In addition, Nb fixes C and N as carbonitrides to develop a recrystallization texture of the cold rolled steel sheet (product sheet), Nb forms an intermetallic compound of Fe and Nb, which is called as Laves phase, Nb has an influence on the formation of the recrystallization texture according to a volume fraction and a size thereof, and thus Nb contributes to an improvement in the r-value.

Since these actions are exhibited in the case where the addition amount of Nb is in a range of 0.30% or greater, the lower limit is set to 0.30%. Since an excessive addition of Nb leads to hardening, and thus this results in a reduction in room temperature ductility, the upper limit is set to 1.0%. The content of Nb is desirably in a range of 0.40% to 0.60% in consideration of costs and manufacturability.

Nitrogen (N): 0.02% or Less in Terms of Mass %

N deteriorates workability and oxidation resistance of steel as is the case with C. Thus, the smaller the content thereof is, the better it is. Therefore, the upper limit is set to 0.02%. However, since an excessive reduction leads to an increase in refining costs, the content of N is desirably in a range of 0.005% to 0.015% in consideration of costs.

Boron (B): 0.0002% to 0.0050% in Terms of Mass %

B is an element which improves secondary workability during press working of the product and improves a high temperature strength in an intermediate temperature range. Since these effects are exhibited in the case where the addition amount of B is in a range of 0.0002% or greater, the lower limit is set to 0.0002%. In the case where B is added in an amount greater than 0.0050%, a B compound such as $Cr_2B$ and the like is generated, intergranular corrosion and fatigue characteristics are deteriorated, {011}-oriented grains are increased, and thus the r-value is reduced. Therefore, the upper limit is set to 0.0050%. Furthermore, the content of B is desirably in a range of 0.0003% to 0.0020% in consideration of weldability and manufacturability.

Aluminum (Al): 0.005% to 0.50% in Terms of Mass %

Al may be added as a deoxidation element and Al improves a high temperature strength and oxidation resistance of steel. Since the actions thereof are exhibited in the case where the amount of Al is in a range of 0.005% or greater, the lower limit is set to 0.005%. In the case where Al is added in an amount greater than 0.50%, elongation of stainless steel is reduced, weldability and surface quality are deteriorated, generation of {011}-oriented grains is promoted by an Al oxide, and the r-value of the steel sheet is reduced, and thus the upper limit is set to 0.50%. The content of Al is desirably in a range of 0.01% to 0.15% in consideration of refining costs.

In addition, in this embodiment, the steel sheet preferably further contains, in terms of mass %, one or more of 0.4% to 2.0% of Cu, 0.1% to 2.0% of Ni, 0.1% to 3.0% of W, 0.05% to 0.30% of Zr, 0.05% to 0.50% of Sn, 0.05% to 0.50% of Co, and 0.0002% to 0.0100% of Mg in addition to the above-described elements.

Copper (Cu): 0.4% to 2.0% in Terms of Mass %

Cu is an element which improves corrosion resistance of stainless steel and increases a high temperature strength especially in the intermediate temperature range by c-Cu precipitation, and thus Cu is added to the steel material if necessary. Since these effects are exhibited in the case where Cu is added in an amount of 0.4% or greater, the lower limit is set to 0.4%. The addition thereof in an amount greater than 2.0% leads to a deterioration in toughness of the steel material and an excessive reduction in elongation. In addition, ε-Cu is excessively precipitated during the course of hot rolling, {011}-oriented grains are generated, and the r-value is reduced. Therefore, the upper limit of the addition amount of Cu is set to 2.0%. The content of Cu is desirably in a range of 0.5% to 1.5% in consideration of oxidation resistance and manufacturability.

Nickel (Ni): 0.1% to 2.0% in Terms of Mass %

Ni is an element which improves toughness and corrosion resistance, and thus Ni is added if necessary. Since the contribution to the toughness is exhibited in the case where the amount of Ni is 0.1% or greater, the lower limit is set to 0.1%. In the case where Ni is added in an amount greater than 2.0%, an austenite phase is generated and the r-value is reduced. Thus, the upper limit is set to 2.0%. The content of Ni is desirably in a range of 0.1% to 0.5% in consideration of costs.

Tungsten (W): 0.1% to 3.0% in Terms of Mass %

W is an element which is added if necessary in order to increase a high temperature strength, and the actions thereof are exhibited in the case where the amount of W is 0.1% or greater. Therefore, the lower limit of the addition amount of W is set to 0.1%. However, an excessive addition leads to a deterioration in toughness of the steel material and a reduction in elongation. In addition, too many Laves phases are generated, and thus {011}-oriented grains are easily generated and the r-value is reduced. Accordingly, the upper limit is set to 3.0%. The content of W is desirably in a range of 0.1% to 2.0% in consideration of manufacturing costs and manufacturability.

Zirconium (Zr): 0.05% to 0.30% in Terms of Mass %

Zr is an element which improves oxidation resistance and is added if necessary. Since the actions thereof are exhibited in the case where the content of Zr is in a range of 0.05% or greater, the lower limit is set to 0.05%. However, the addition in an amount greater than 0.30% causes a significant deterioration in manufacturability such as toughness and a pickling property, and also causes coarsening of a compound of Zr, carbon, and nitrogen, and thus the microstructure of the hot rolled and annealed sheet is grain-coarsened and the r-value is reduced. Therefore, the upper limit is set to 0.30%. The content of Zr is desirably in a range of 0.05% to 0.20% in consideration of manufacturing costs.

Tin (Sn): 0.05% to 0.50% in Terms of Mass %

Sn is an element which is added if necessary in order to increase a high temperature strength by segregation in a grain boundary. Since the actions thereof are exhibited in the case where the content of Sn is in a range of 0.05% or greater, the lower limit is set to 0.05%. However, the addition in an amount greater than 0.5% causes generation of Sn segregation, and thus {011}-oriented grains are generated in the segregation portion and the r-value is reduced. Therefore, the upper limit is set to 0.50%. The content of Sn is desirably in a range of 0.10% to 0.30% in consideration of high temperature characteristics, manufacturing costs, and toughness.

Cobalt (Co): 0.05% to 0.50% in Terms of Mass %

Co is an element which improves a high temperature strength and is added in an amount of 0.05% or greater if necessary. However, since an excessive addition deteriorates workability, the upper limit is set to 0.50%. The content of Co is desirably in a range of 0.05% to 0.30% in consideration of manufacturing costs.

Magnesium (Mg): 0.0002% to 0.0100% in Terms of Mass %

Mg forms an Mg oxide together with Al in molten steel and Mg acts as a deoxidizer. Moreover, the fine crystallized Mg oxide serves as a nucleus and Nb-based precipitates or Ti-based precipitates are finely precipitated. When these are finely precipitated in the hot rolling process, the fine precipitates suppress recrystallization and formation of {011}-oriented grains in the hot rolling process and in the annealing process of a hot rolled sheet, and the fine precipitates contributes to formation of the non-recrystallized microstructure. Since this action is exhibited in the case where the amount of Mg is in a rage of 0.0002% or greater, the lower limit is set to 0.0002%. However, since an excessive addition of Mg leads to a deterioration in oxidation resistance of the steel material, a reduction in weldability, and the like, the upper limit is set to 0.0100%. The content of Mg is desirably in a range of 0.0003% to 0.0020% in consideration of refining costs.

Next, the texture of a cold rolled ferritic stainless steel sheet of this embodiment will be described.

Regarding the texture of a cold rolled ferritic stainless steel sheet of this embodiment, it is important that when a sheet thickness is represented by t, an area ratio of crystal grains having a {111} orientation (hereinafter, simply referred to as {111}-oriented grains) in a region from the surface layer to t/4 (a region ranging from the surface to a depth of t/4) is in a range of 20% or greater, and an area ratio of {111}-oriented grains in a region from t/4 to t/2 (a region ranging from a depth of t/4 to the center in the sheet thickness direction) is in a range of 40% or greater. Furthermore, it is important that an area ratio of crystal grains having a {011} orientation (hereinafter, simply referred to as {011}-oriented grains) in the entire region in the sheet thickness direction is in a range of 15% or less.

The crystal grains having a {111} orientation are crystal grains in which the crystal orientation is indicated by plane index {111}, that is, crystal grains in which the sheet surface (the surface of the steel sheet) and the {111} plane are in parallel. The crystal grains having a {011} orientation are crystal grains in which the crystal orientation is indicated by plane index {011}, that is, crystal grains in which the sheet surface and the {011} plane are in parallel.

The area ratios of the {111}-oriented grains and the {011}-oriented grains can be obtained as an area ratio of the crystal grains having the respective orientations in a plane which is perpendicular to the surface of the steel sheet and in parallel to the rolling direction.

Hereinafter, the reasons for restricting the texture of this embodiment will be described.

It is a well-known fact that the Lankford value (r-value) which is an index of workability improvement is related to the recrystallization texture. In general, it is known that the r-value is improved by increasing the ratio of crystal grains having a {111} orientation. However, the crystal orientation distribution was not uniform in the sheet thickness direction, and a sufficiently high r-value was not necessarily secured only with the control of the crystal orientation of a specific portion.

Accordingly, in the invention, the relationship between the crystal orientation distribution in the sheet thickness direction of the cold rolled steel sheet (product sheet) and the r-value was examined in consideration of non-uniformity in the sheet thickness direction. As a result, it was proved that area ratios of {111}-oriented grains present in a region from the surface layer to t/4 (t is a sheet thickness) and in a region from t/4 to t/2 are required to be in a range of 20% or greater and in a range of 40% or greater, respectively. In addition, it was proved that an area ratio of {011}-oriented grains present in the entire region in the thickness direction is required to be in a range of 15% or less. In order to more stably secure the r-value, the area ratio of the {111}-oriented grains is preferably in a range of 25% or greater in the region from the surface layer to t/4 and the area ratio of the {111}-oriented grains is preferably in a range of 45% or greater in the region from t/4 to t/2, and the area ratio of the {011}-oriented grains are preferably in a range of 10% or less.

Figure 2:
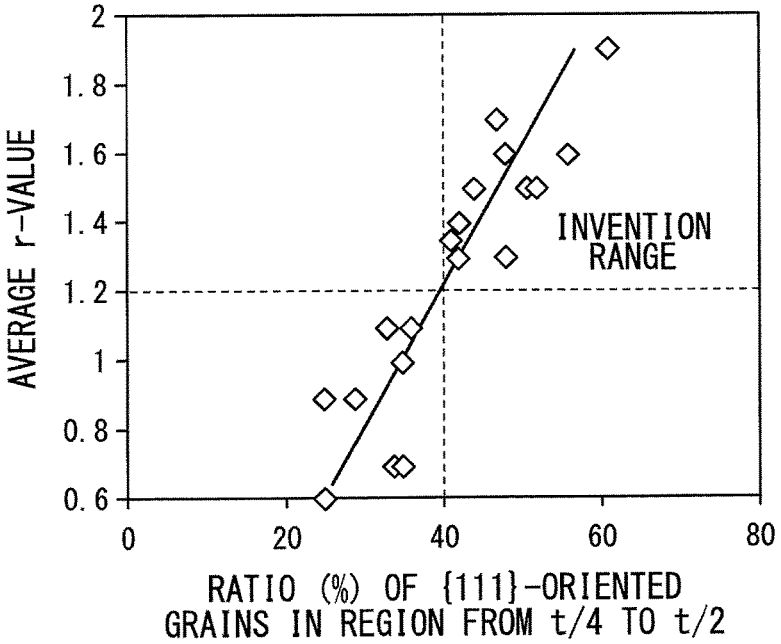
FIG. 2 is a graph showing a relationship between an area ratio of {111}-oriented grains in a region from t/4 to t/2 (t: sheet thickness) and an average r-value in the cold rolled ferritic stainless steel sheet of the embodiment.
Figure 3:
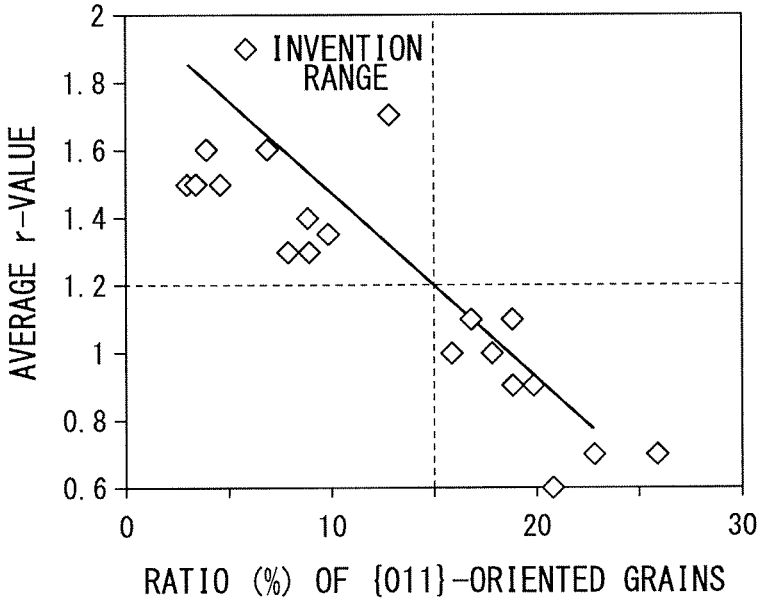
FIG. 3 is a graph showing a relationship between an area ratio of {011}-oriented grains in the entire region in a sheet thickness direction and an average r-value in the cold rolled ferritic stainless steel sheet of the embodiment.

FIGS. 1 to 3 show the relationship between the area ratio (ratio) in the respective crystal orientations and an average r-value of a product sheet.

Here, regarding the r-value, a JIS13-B tensile test piece is collected from a cold rolled and annealed sheet and a strain of 14.4% is applied in a rolling direction, in a direction at an angle of 45° with respect to the rolling direction, and in a direction at an angle of 900 with respect to the rolling direction. Then, an average r-value is calculated using the following Expressions (1) and (2).

$$r=\ln(W_0/W)/\ln(t_0/t) \quad (1)$$

Here, $W_0$ represents a sheet width before pulling, W represents a sheet width after pulling, $t_0$ represents a sheet thickness before pulling, and t represents a sheet thickness after pulling.

$$\text{Average } r\text{-value}=(r_0+2r_{45}+r_9)/4 \quad (2)$$

Here, $r_0$ represents an r-value in the rolling direction, $r_{45}$ represents an r-value in a direction at an angle of 45° with respect to the rolling direction, and $r_{90}$ represents an r-value in a direction at a right angle with respect to the rolling direction.

An exhaust component required to have a complicated shape can be subjected to sufficient working in the case where the average r-value is in a range of 1.2 or greater. Therefore, in this embodiment, a component having an average r-value of 1.2 or greater is judged to have excellent workability.

Regarding the measurement of the crystal orientation, a plane in a direction parallel to the rolling direction is cut out of the product sheet at a right angle to the sheet surface, and orientations of crystal grains are identified over the entire region in the sheet thickness direction using a crystal orientation analysis apparatus EBSP (Electron Back Scatter diffraction Pattern) to determine area ratios of {111}-oriented grains and {011}-oriented grains. From these results, in the invention, it is obvious that for increasing the r-value by crystal orientation control, it is necessary to consider a fluctuation in the {111}-oriented grain frequency in the sheet thickness direction and also to consider the {011}-oriented grains.

FIG. 1 is a graph showing a relationship between an area ratio of {111}-oriented grains in a region from the surface layer to t/4 and an average r-value in a cold rolled ferritic stainless steel sheet of this embodiment, and FIG. 2 is a graph showing a relationship between an area ratio of {111}-oriented grains in a region from t/4 to t/2 and an average r-value.

As can be seen from FIGS. 1 and 2, the higher the ratio of the {111}-oriented grains is, the higher the average r-value is, and thus it is found that the workability is improved. Furthermore, it is found that in order to secure the average r-value of 1.2 or greater, it is important to secure 20% or greater of {111}-oriented grains in the region from the surface layer of the steel sheet to a depth of t/4 and also to secure 40% of {111}-oriented grains in the region from t/4 to t/2.

The steel component of the cold rolled ferritic stainless steel sheet used to examine the relationships shown in FIGS. 1 and 2 includes 0.007% of C, 0.27% of Si, 0.94% of Mn, 0.03% of P, 0.0006% of S, 17.3% of Cr, 1.8% of Mo, 0.08% of Ti, 0.47% of Nb, 0.01% of N, 0.001% of B, and 0.03% of Al (the balance being Fe and inevitable impurities).

FIG. 3 is a graph showing a relationship between an area ratio of {011}-oriented grains in the entire region in the sheet thickness direction and an average r-value in the cold rolled ferritic stainless steel sheet of this embodiment.

As can be seen from FIG. 3, the higher the ratio of the {011}-oriented grains in the entire region in the sheet thickness direction is, the lower the average r-value is, and it is found that the workability deteriorates. Furthermore, it is found that in order to secure the average r-value of 1.2 or greater, it is important to secure 15% or less of {011}-oriented grains in the entire region in the thickness direction.

The steel component of the cold rolled ferritic stainless steel sheet used to examine the relationship shown in FIG. 3 includes 0.007% of C, 0.27% of Si, 0.94% of Mn, 0.03% of P, 0.0006% of S, 17.3% of Cr, 1.8% of Mo, 0.08% of Ti, 0.47% of Nb, 0.01% of N, 0.001% of B, and 0.03% of Al (the balance being Fe and inevitable impurities).

Next, a hot rolled ferritic stainless steel sheet for a material for cold rolling, which is a raw material of the cold rolled ferritic stainless steel sheet as described above, will be described.

In the invention, the manufacturing method was examined as well as the texture and the component composition of the cold rolled steel sheet (cold rolled sheet); and as a result, it was found that the texture of the cold rolled sheet is influenced by the microstructure of the hot rolled steel sheet (hot rolled sheet for a material for cold rolling) which is a raw material of the cold rolled steel sheet, and thus the r-value of the cold rolled sheet is influenced.

That is, it was found that when the microstructure in a region from t'/4 to t'/2 (t' is a sheet thickness of the hot rolled sheet for a material for cold rolling) in the hot rolled sheet for a material for cold rolling is a non-recrystallized microstructure, the cold rolled steel sheet manufactured from such a hot rolled sheet for a material for cold rolling has a high r-value. The region from t'/4 to t'/2 is a region ranging from a depth of t/4 from the surface of the steel sheet to the center in the sheet thickness direction.

Specifically, as described above, for an improvement in the r-value in the cold rolled sheet, it is effective to secure crystal grains having a {111} orientation. Therefore, it is very important to develop a {111} texture in the hot rolled steel sheet which is a raw material of the cold rolled sheet and also very important for the texture to be a non-recrystallized microstructure without being recrystallized. That is, in the non-recrystallized microstructure, in a cross-section which is in parallel to the rolling direction of the hot rolled steel sheet and is perpendicular to the sheet surface, crystal grains exhibits an orientation indicated by plane index {111} (an orientation in which the sheet surface and the {111} plane are in parallel).

Hereinafter, a method of manufacturing the hot rolled ferritic stainless steel sheet for a material for cold rolling will be described.

(Method of Manufacturing Hot Rolled Ferritic Stainless Steel Sheet for Material for Cold Rolling)

Next, a method of manufacturing a hot rolled ferritic stainless steel sheet for a material for cold rolling of this embodiment will be described.

The method of manufacturing a hot rolled ferritic stainless steel sheet for a material for cold rolling of this embodiment includes: manufacturing ferritic stainless steel having the above-described steel composition; after the manufacturing of the steel, subjecting a semi-finished product (slab) which is cast to hot rolling under conditions where a heating temperature of a slab is set to be in a range of 1200° C. to 1300° C. and a finishing temperature is set to be in a range of 800° C. to 950° C. so as to form a hot rolled sheet; coiling the hot rolled sheet at a coiling temperature of 500° C. or lower, and then, annealing the hot rolled sheet at a temperature of 925° C. to 1000° C.

In the hot rolling, a hot rolling strain caused by rolling is excessively introduced in the case where a heating temperature of a slab is in a range of lower than 1200° C., and thus it becomes difficult to perform the subsequent control of microstructure and surface scratches become a problem. Accordingly, the lower limit is set to 1200° C. In the case where the heating temperature is in a range of higher than 1300° C., the microstructure after the hot rolling is grain-coarsened. Thus, the development of the {111} texture is suppressed and the structure may be a recrystallized microstructure. Accordingly, the upper limit is set to 1300° C. The heating temperature is desirably in a range of 1230° C. to 1280° C. in consideration of productivity.

In the hot rolling, after the slab heating, a plurality of passes of rough rolling are performed and then, a plurality of passes of finish rolling are performed, and thereafter, the steel sheet is coiled in a coil shape. In this case, in the case where the finishing temperature is in a range of lower than 800° C., surface scratches become a problem, and thus the lower limit of the finishing temperature is set to 800° C. In the case where the finishing temperature is in a range of higher than 950° C., the microstructure after the hot rolling is grain-coarsened. Thus, the development of the {111} texture is suppressed and the microstructure may be a recrystallized microstructure. Accordingly, the upper limit is set to 950° C. The finishing temperature is desirably in a range of 850° C. to 930° C. in consideration of productivity.

The coiling temperature is set to be in a range of 500° C. or lower from the viewpoint of the suppression of recovery of the hot rolled microstructure and the toughness of the hot rolled sheet. That is, in the invention, in the case where the coiling temperature is set to be a low temperature of 500° C. or lower, the {111} texture obtained through the hot rolling process is not recovered, and while the texture is maintained, the subsequent processes can be proceeded. The coiling temperature is desirably in a range of 400° C. to 480° C. in consideration of productivity, toughness, and coil shape. In the case where the coiling temperature is in a range of higher than 500° C., even when the annealing temperature is appropriate in the subsequent annealing process of a hot rolled sheet, {110}-oriented grains caused by a hot rolling shear strain generated in the vicinity of the surface layer portion of the sheet thickness are grown during the course of cooling to the room temperature after coiling of a hot rolled sheet, {110}-oriented grains encroach another orientation in the subsequent annealing process; and thereby, {110}-oriented grains remain in the product sheet. Since the {110}-oriented grains lead to a reduction in the r-value, the coiling temperature is set to be in a range of 500° C. or lower. In order to suppress the growth of the {110}-oriented grains during the processes until the coiling after the hot finish rolling, cooling is desirably performed at a cooling rate of 50° C./sec or greater.

In general, in the annealing of a hot rolled sheet after the hot rolling, a heat treatment is performed at a temperature at which a recrystallized microstructure is obtained. However, non-uniformity occurs in the microstructure in the sheet thickness direction.

In the invention, it was found that the non-uniformity in the microstructure in the sheet thickness direction has a large influence on the r-value of the product sheet, and also found that as described above, in the case where the microstructure in a region from t'/4 to t'/2 (t' is a sheet thickness) is a non-recrystallized microstructure, the cold rolled steel sheet, that is, the product sheet obtains a high r-value.

Figure 4:
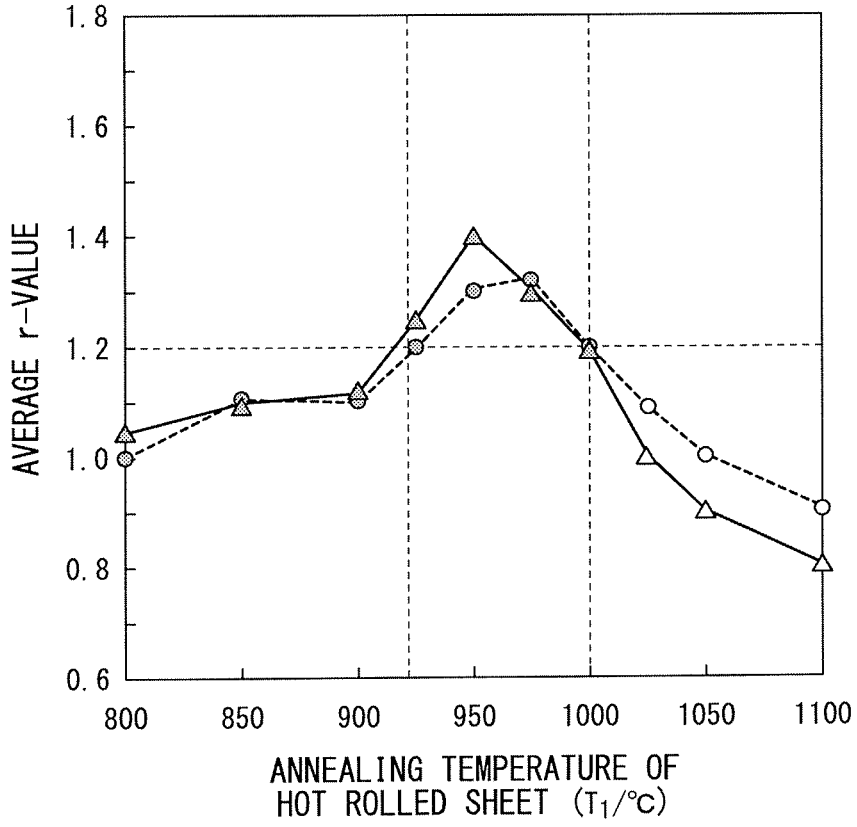
FIG. 4 is a graph showing a relationship between an annealing temperature TI of a hot rolled sheet and an average r-value of a cold rolled ferritic stainless steel sheet (product sheet) of the embodiment.

FIG. 4 shows a relationship between an annealing temperature of a hot rolled sheet and an average r-value of a product sheet. Here, steel A (represented by the reference symbols ● and ○ in FIG. 4) has a composition including 0.007% of C, 0.25% of Si, 0.95% of Mn, 0.03% of P, 0.0006% of S, 17.3% of Cr, 1.8% of Mo, 0.08% of Ti, 0.47% of Nb, 0.01% of N, 0.0010% of B, and 0.03% of Al (the balance being Fe and inevitable impurities). Steel B (represented by the reference symbols ▲ and Δ in FIG. 4) has a composition including 0.003% of C, 0.89% of Si, 0.65% of Mn, 0.02% of P, 0.0010% of S, 13.5% of Cr, 0.1% of Mo, 0.008% of Ti, 0.40% of Nb, 0.01% of N, 0.0005% of B, and 0.07% of Al (the balance being Fe and inevitable impurities). FIG. 4 also shows a microstructure state of the region from t'/4 to t'/2 after annealing of a hot rolled sheet. The reference symbols ● and ▲ represent a non-recrystallized microstructure, and the reference symbols ○ and Δ represent a recrystallized microstructure.

The recrystallization temperature varies with the steel component. However, in the composition of the invention, an appropriate annealing temperature of a hot rolled sheet can be found in the range of 925° C. to 1000° C. That is, a temperature can be found at which a non-recrystallized microstructure (which does not change into a full-recrystallized microstructure), that is an appropriate microstructure for the hot rolled sheet for a material for cold rolling, is obtained at a depth of t'/4 to t'/2 (t' is a sheet thickness of the hot rolled sheet for a material for cold rolling). When the hot rolled sheet for a material for cold rolling is used as a raw material of a cold rolled steel sheet, a material with excellent formability having an average r-value of 1.2 or greater can be obtained.

Here, in a normal manufacturing method, in the case where a region from t'/4 to t'/2 in a hot rolled sheet for a material for cold rolling has a recrystallized microstructure, a random crystal orientation distribution is obtained, and thus the texture development in the subsequent cold rolling is not sufficient and {111}-oriented grains are not sufficiently generated after annealing of a cold rolled sheet. On the other hand, in the case where the region from t'/4 to t'/2 in the hot rolled sheet for a material for cold rolling has a non-recrystallized microstructure as in the invention, cold rolling is performed while the {111} texture developed in the hot rolled sheet remain. Therefore, many {111}-oriented grains are generated in the subsequent annealing of a cold rolled sheet, and {111}-oriented grains contribute to a high r-value.

However, in the case where the annealing temperature of a hot rolled sheet is too low or the annealing of a hot rolled sheet is omitted, many {110}-oriented grains, which are caused by the hot rolling shear strain generated in the vicinity of the surface layer portion of the sheet thickness, remain in the product sheet after annealing of a cold rolled sheet. Since these oriented grains lead to a reduction in the r-value, the annealing of a hot rolled sheet is required to be performed at a temperature of 800° C. or higher. In the invention, in order to further suppress the growth of the {110}-oriented grains having an adverse influence on the improvement in the r-value and to adjust the average r-value to be in a range of 1.2 or greater, the lower limit of the annealing temperature of a hot rolled sheet is set to 925° C.

In the case where the annealing of a hot rolled sheet is performed at a temperature of higher than 1000° C., the microstructure of the region from t'/4 to t'/2 is recrystallized, and thus the recrystallized grains in the surface layer are coarsened and a compound of Fe and Nb ($Fe_2Nb$), which is called as Laves phase, is completely dissolved after the annealing of a hot rolled sheet. Thus, the r-value is reduced. Since the Laves phase coarsely generated through the annealing of a hot rolled sheet becomes a nucleus generation site of the recrystallization texture during the annealing of a cold rolled sheet, it is desirably that Laves phase be precipitated in the material for cold rolling.

The upper limit of the annealing temperature of a hot rolled sheet is set to 1000° C. in consideration of these points. Furthermore, since coarsening of crystal grains and promotion of scale generation due to high temperature annealing lead to a reduction in surface quality such as fracture of the sheet and scale residues, the annealing temperature of a hot rolled sheet is desirably in a range of 925° C. to 980° C. in consideration of toughness of the hot rolled sheet and a pickling property.

(Method of Manufacturing Cold Rolled Ferritic Stainless Steel Sheet)

Next, the hot rolled sheet for a material for cold rolling is subjected to cold rolling to have a thickness of 2 mm, and is subjected to a heat treatment at a temperature of 1000° C. to 1100° C. according to the steel component so that the grain size number becomes in a range of 5 to 7. Thereby, a product sheet is formed.

Specifically, first, the cold rolling reduction ratio is set to be in a range of 60% or greater in order to obtain recrystallization nuclei which grow into the {111}-oriented crystals in the cold rolled sheet. That is, in the case where the cold rolling reduction ratio is too low, recrystallization nuclei for recrystallization into {111}-oriented grains through the following annealing process cannot be sufficiently generated, and thus the r-value of the product sheet is not sufficiently improved. Therefore, it is important that the rolling reduction ratio is set to be in a range of 60% or greater. The rolling reduction ratio is desirably in a range of 60% to 80% in consideration of productivity and anisotropy.

Next, with regard to the cold rolled sheet in which the recrystallization nuclei that grow into the {111}-oriented crystals are generated, annealing of the cold rolled sheet is performed at a temperature of 1000° C. to 1100° C. In general, in the annealing of the cold rolled sheet, the heat treatment temperature is determined according to the steel component in order to obtain a recrystallized microstructure. However, in the case where the temperature is in a range of lower than 1000° C., a non-recrystallized microstructure is obtained in the steel component of the invention, and thus the lower limit is set to 1000° C. In the case where the temperature is in a range of higher than 1100° C., the crystal grains are coarsened, and surface deterioration occurs during working and causes cracking. Therefore, the upper limit is set to 1100° C. The heat treatment temperature is desirably in a range of 1010° C. to 1070° C. in consideration of elongation and a pickling property.

As described above, it is possible to obtain a cold rolled ferritic stainless steel sheet having excellent workability in which the area ratio of the {111}-oriented grains is increased and the {011}-oriented grains are suppressed.

The thickness of the slab, the thickness of the hot rolled sheet, and the like may be appropriately designed. In addition, in the cold rolling, the roll roughness and the roll diameter of a used work roll, a rolling oil, the number of passes of rolling, the rolling rate, the rolling temperature, and the like may be appropriately selected. In addition, if necessary, for the annealing of a cold rolled sheet, bright annealing may be performed so that the annealing is performed under a non-oxidation atmosphere such as hydrogen gas or nitrogen gas, or the annealing may be performed in the air.

EXAMPLES

Hereinafter, effects of the invention will be described using examples, but the invention is not limited to the conditions used in the following examples.

Example 1

In this example, first, steel having a component composition shown in Table 1 was melted to cast a slab, and the slab was subjected to hot rolling to form a hot rolled sheet having a thickness of 5.0 mm. Thereafter, the hot rolled sheet was subjected to continuous annealing, and then subjected to pickling. The resulting material was subjected to cold rolling to have a thickness of 2.0 mm and was subjected to continuous annealing and pickling to form a product sheet. Among the component compositions shown in Table 1, steels Nos. 1 to 13 are out of the scope of the invention, and steels Nos. 14 to 32 are out of the scope of the invention. The component compositions out of the scope of the invention are indicated by an underline.

In all of the cases, the hot rolling conditions were within the scope of the invention. The heating temperature of a slab was set to be in a range of 1200° C. to 1300° C., the finishing temperature was set to be in a range of 800° C. to 950° C., and the coiling temperature was set to be in a range of 500° C. or lower. In addition, regarding the annealing conditions of a hot rolled sheet, the annealing temperature was set to be in a range of 800° C. to 1000° C. and to be a temperature at which a non-recrystallized microstructure is obtained in a region of a depth of t'/2 to t'/4 (t': a sheet thickness of a hot rolled sheet). Thereafter, cold rolling was performed at a rolling reduction ratio of 60%. The annealing of a cold rolled sheet was performed at a temperature of 1000° C. to 1100° C. according to the steel component so that a recrystallized microstructure is obtained.

TABLE 1

| | Steel | Component Composition (mass %) | | | | | | | | | | | |
|---|---|---|---|---|---|---|---|---|---|---|---|---|---|
| | No. | C | Si | Mn | P | S | Cr | Mo | Ti | Nb | N | B | Al |
| Invention Examples | 1 | 0.007 | 0.27 | 0.94 | 0.03 | 0.0006 | 17.3 | 1.8 | 0.08 | 0.47 | 0.010 | 0.0010 | 0.03 |
| | 2 | 0.005 | 0.10 | 0.71 | 0.01 | 0.0002 | 16.2 | 1.7 | 0.11 | 0.55 | 0.005 | 0.0005 | 0.07 |
| | 3 | 0.010 | 0.88 | 0.62 | 0.02 | 0.0012 | 14.2 | 0.5 | 0.09 | 0.32 | 0.013 | 0.0021 | 0.11 |
| | 4 | 0.006 | 0.35 | 0.85 | 0.04 | 0.0025 | 18.9 | 1.5 | 0.15 | 0.45 | 0.005 | 0.0009 | 0.008 |
| | 5 | 0.002 | 0.15 | 0.77 | 0.01 | 0.0005 | 17.2 | 1.6 | 0.006 | 0.45 | 0.011 | 0.0013 | 0.04 |
| | 6 | 0.003 | 0.21 | 0.89 | 0.02 | 0.0015 | 17.5 | 0.2 | 0.09 | 0.53 | 0.015 | 0.0008 | 0.02 |
| | 7 | 0.013 | 0.91 | 0.61 | 0.03 | 0.0011 | 13.5 | 0.1 | 0.007 | 0.35 | 0.013 | 0.0008 | 0.06 |
| | 8 | 0.015 | 0.55 | 0.65 | 0.04 | 0.0018 | 14.3 | 0.5 | 0.07 | 0.41 | 0.011 | 0.0008 | 0.03 |
| | 9 | 0.009 | 0.25 | 0.85 | 0.03 | 0.0007 | 17.5 | 1.6 | 0.05 | 0.45 | 0.013 | 0.0011 | 0.04 |
| | 10 | 0.008 | 0.23 | 0.91 | 0.04 | 0.0007 | 17.9 | 2.6 | 0.006 | 0.55 | 0.016 | 0.0009 | 0.05 |
| | 11 | 0.012 | 0.19 | 0.62 | 0.03 | 0.0008 | 19.1 | 2.8 | 0.07 | 0.53 | 0.006 | 0.0019 | 0.13 |
| | 12 | 0.018 | 0.11 | 0.75 | 0.01 | 0.0031 | 13.2 | 1.6 | 0.12 | 0.44 | 0.016 | 0.0013 | 0.33 |
| | 13 | 0.003 | 0.63 | 0.85 | 0.04 | 0.0003 | 15.2 | 1.1 | 0.07 | 0.65 | 0.006 | 0.0030 | 0.45 |

| | Steel | Component Composition (mass %) | | | | | | |
|---|---|---|---|---|---|---|---|---|
| | No. | Cu | Ni | W | Zr | Sn | Co | Mg |
| Invention Examples | 1 | — | — | — | — | — | — | — |
| | 2 | — | — | — | — | — | — | — |
| | 3 | — | — | — | — | — | — | — |
| | 4 | — | — | — | — | — | — | — |
| | 5 | — | — | — | — | — | — | — |
| | 6 | 1.2 | — | — | — | — | — | — |
| | 7 | — | 1.1 | — | — | — | — | — |
| | 8 | — | — | — | — | 0.2 | — | — |
| | 9 | 0.4 | — | — | — | — | — | 0.0005 |
| | 10 | 1.5 | — | 0.13 | — | — | — | — |
| | 11 | 1.4 | 0.2 | 1.5 | — | — | — | — |
| | 12 | — | — | — | 0.09 | — | — | — |
| | 13 | 0.4 | 0.3 | — | — | 0.1 | 0.08 | — |

TABLE 1-continued

| | Steel No. | Component Composition (mass %) C | Si | Mn | P | S | Cr | Mo | Ti | Nb | N | B | Al |
|---|---|---|---|---|---|---|---|---|---|---|---|---|---|
| Comparative Examples | 14 | 0.035 | 0.34 | 0.76 | 0.02 | 0.0009 | 16.8 | 1.5 | 0.09 | 0.41 | 0.011 | 0.0008 | 0.03 |
| | 15 | 0.013 | 0.03 | 0.35 | 0.02 | 0.0009 | 14.3 | 1.3 | 0.13 | 0.45 | 0.007 | 0.0011 | 0.04 |
| | 16 | 0.008 | 0.91 | 0.45 | 0.02 | 0.0012 | 14.5 | 0.5 | 0.11 | 0.40 | 0.005 | 0.0016 | 0.11 |
| | 17 | 0.011 | 0.75 | 0.66 | 0.08 | 0.0001 | 14.5 | 1.5 | 0.12 | 0.38 | 0.005 | 0.0035 | 0.01 |
| | 18 | 0.004 | 0.95 | 1.30 | 0.01 | 0.0164 | 18.8 | 1.1 | 0.16 | 0.42 | 0.013 | 0.0006 | 0.35 |
| | 19 | 0.012 | 0.22 | 0.98 | 0.04 | 0.0001 | 11.5 | 1.5 | 0.11 | 0.31 | 0.005 | 0.0009 | 0.16 |
| | 20 | 0.004 | 0.36 | 1.2 | 0.02 | 0.0015 | 14.0 | 3.5 | 0.08 | 0.55 | 0.013 | 0.0015 | 0.05 |
| | 21 | 0.005 | 0.54 | 1.15 | 0.03 | 0.0053 | 14.1 | 1.5 | 0.003 | 0.65 | 0.015 | 0.0033 | 0.04 |
| | 22 | 0.008 | 0.91 | 1.38 | 0.01 | 0.0015 | 19.5 | 1.5 | 0.18 | 0.12 | 0.005 | 0.0006 | 0.03 |
| | 23 | 0.013 | 0.13 | 0.64 | 0.04 | 0.0033 | 14.1 | 2.3 | 0.01 | 0.47 | 0.032 | 0.0008 | 0.12 |
| | 24 | 0.018 | 0.15 | 1.35 | 0.02 | 0.0023 | 16.8 | 0.6 | 0.03 | 0.33 | 0.006 | 0.0064 | 0.15 |
| | 25 | 0.002 | 0.11 | 1.05 | 0.03 | 0.0013 | 16.5 | 1.1 | 0.07 | 0.39 | 0.017 | 0.0019 | 0.64 |
| | 26 | 0.006 | 0.35 | 0.85 | 0.02 | 0.0023 | 16.8 | 0.6 | 0.11 | 0.31 | 0.006 | 0.0045 | 0.03 |
| | 27 | 0.009 | 0.85 | 0.86 | 0.01 | 0.0016 | 14.3 | 2.2 | 0.11 | 0.66 | 0.010 | 0.0043 | 0.02 |
| | 28 | 0.014 | 0.88 | 0.96 | 0.04 | 0.0022 | 14.5 | 1.6 | 0.13 | 0.53 | 0.013 | 0.0013 | 0.05 |
| | 29 | 0.012 | 0.26 | 0.95 | 0.03 | 0.0007 | 17.3 | 0.6 | 0.08 | 0.33 | 0.016 | 0.0011 | 0.13 |
| | 30 | 0.011 | 0.25 | 1.03 | 0.05 | 0.0011 | 14.1 | 0.7 | 0.07 | 0.41 | 0.013 | 0.0019 | 0.009 |
| | 31 | 0.006 | 0.36 | 1.05 | 0.01 | 0.0025 | 16.3 | 1.2 | 0.15 | 0.51 | 0.009 | 0.0028 | 0.01 |
| | 32 | 0.005 | 0.49 | 1.35 | 0.02 | 0.0021 | 18.6 | 1.9 | 0.009 | 0.62 | 0.005 | 0.0009 | 0.01 |

| | Steel No. | Component Composition (mass %) Cu | Ni | W | Zr | Sn | Co | Mg |
|---|---|---|---|---|---|---|---|---|
| Comparative Examples | 14 | — | — | — | — | — | — | — |
| | 15 | — | — | — | — | — | — | — |
| | 16 | — | — | — | — | — | — | — |
| | 17 | — | — | — | — | — | — | — |
| | 18 | — | — | — | — | — | — | — |
| | 19 | — | — | — | — | — | — | — |
| | 20 | — | — | — | — | — | — | — |
| | 21 | — | — | — | — | — | — | — |
| | 22 | — | — | — | — | — | — | — |
| | 23 | — | — | — | — | — | — | — |
| | 24 | — | — | — | — | — | — | — |
| | 25 | — | — | — | — | — | — | — |
| | 26 | 2.6 | — | — | — | — | — | — |
| | 27 | — | 3.4 | — | — | — | — | — |
| | 28 | — | — | 3.6 | — | — | — | — |
| | 29 | — | — | — | 0.45 | — | — | — |
| | 30 | — | — | — | — | 0.63 | — | — |
| | 31 | — | — | — | — | — | 0.77 | — |
| | 32 | — | — | — | — | — | — | 0.0265 |

Next, from the product sheet obtained in this manner, a test piece was collected to measure ratios (area ratios) of {111}-oriented grains and {011}-oriented grains and to evaluate an average r-value, a high temperature strength, and oxidation characteristics. The measurement and evaluation methods will be described in detail.

The methods of measuring the ratio of the crystal-oriented grains and the average r-value are the same as the above-described method. A plane in a direction parallel to the rolling direction was cut out of the obtained product sheet at a right angle to the sheet surface, and orientations of crystal grains were identified over the entire region in the sheet thickness direction using a crystal orientation analysis apparatus EBSP to determine area ratios of {111}-oriented grains and {011}-oriented grains.

In addition, regarding the average r-value, a JIS13-B tensile test piece was collected from the obtained product sheet and a strain of 14.4% was applied in the rolling direction, in a direction at an angle of 45° with respect to the rolling direction, and in a direction at an angle of 90° with respect to the rolling direction based on JIS Z 2254. Then, the average r-value was calculated using the above-described Expressions (1) and (2). In the evaluation of workability, the workability was evaluated to be favorable in the case where the average r-value was in a range of 1.2 or greater.

Next, regarding the high temperature strength, a high temperature tensile test piece was collected in the rolling direction from the obtained product sheet, and a high temperature tensile test was performed at 900° C. based on JIS G 0567 to measure a 0.2% proof stress.

In the oxidation resistance test, a continuous oxidation test was performed at 900° C. for 200 hours in the air based on JIS Z 2281 to evaluate breakaway and occurrence of scale peeling.

In the case where a 0.2% proof stress which is the high temperature strength at 900° C. is in a range of 20 MPa or greater and in the case where breakaway does not occur in continuous oxidation in the air, a performance as an exhaust component for a vehicle is satisfied. Therefore, a case in which the 0.2% proof stress was less than 20 MPa was evaluated as failing. A case in which breakaway and scale peeling did not occur was evaluated as A (good), and a case in which breakaway and scale peeling occurred was evaluated as B (bad).

The evaluation results are shown in Table 2.

TABLE 2

| Test No. | Steel No. | Crystal Orientation Ratio of Product Sheet: Ratio of {111}-Oriented Grains in Region from Surface Layer to t/4 (%) | Ratio of {111}-Oriented Grains in Region from t/4 to t/2 (%) | Ratio of {011}-Oriented Grains (%) | Average r-Value of Product Sheet | High-Temperature Strength at 900° C. (MPa) | Continuous Oxidation at 900° C. Oxidation Characteristics | |
|---|---|---|---|---|---|---|---|---|
| P1 | 1 | 22 | 48 | 8 | 1.3 | 23 | A | Invention Examples |
| P2 | 2 | 36 | 41 | 9 | 1.2 | 25 | A | |
| P3 | 3 | 41 | 49 | 2 | 1.6 | 21 | A | |
| P4 | 4 | 29 | 52 | 4 | 1.5 | 24 | A | |
| P5 | 5 | 31 | 35 | 11 | 1.4 | 24 | A | |
| P6 | 6 | 26 | 56 | 7 | 1.6 | 21 | A | |
| P7 | 7 | 27 | 51 | 3 | 1.5 | 20 | A | |
| P8 | 8 | 25 | 42 | 9 | 1.3 | 21 | A | |
| P9 | 9 | 31 | 44 | 5 | 1.5 | 24 | A | |
| P10 | 10 | 27 | 48 | 4 | 1.6 | 27 | A | |
| P11 | 11 | 39 | 47 | 13 | 1.7 | 28 | A | |
| P12 | 12 | 33 | 43 | 2 | 1.8 | 24 | A | |
| P13 | 13 | 40 | 61 | 6 | 1.9 | 26 | A | |
| P14 | 14 | 18 | 35 | 26 | 0.7 | 17 | B | Comparative Examples |
| P15 | 15 | 19 | 35 | 13 | 1.0 | 19 | B | |
| P16 | 16 | 21 | 42 | 9 | 1.2 | 20 | B | |
| P17 | 17 | 18 | 36 | 17 | 1.1 | 22 | B | |
| P18 | 18 | 19 | 33 | 19 | 1.1 | 20 | B | |
| P19 | 19 | 28 | 51 | 10 | 1.2 | 19 | B | |
| P20 | 20 | 21 | 35 | 23 | 1.0 | 24 | B | |
| P21 | 21 | 11 | 29 | 11 | 0.9 | 19 | A | |
| P22 | 22 | 10 | 25 | 11 | 0.9 | 17 | A | |
| P23 | 23 | 17 | 34 | 23 | 0.7 | 17 | B | |
| P24 | 24 | 22 | 45 | 19 | 1.0 | 21 | B | |
| P25 | 25 | 31 | 41 | 20 | 1.1 | 21 | A | |
| P26 | 26 | 25 | 45 | 26 | 0.8 | 25 | B | |
| P27 | 27 | 19 | 35 | 14 | 1.0 | 22 | A | |
| P28 | 28 | 21 | 33 | 23 | 0.8 | 24 | A | |
| P29 | 29 | 29 | 41 | 20 | 0.9 | 22 | A | |
| P30 | 30 | 31 | 49 | 25 | 0.8 | 21 | B | |
| P31 | 31 | 15 | 25 | 21 | 0.6 | 21 | A | |
| P32 | 32 | 23 | 41 | 10 | 1.2 | 20 | B | |

As is obvious from Tables 1 and 2, it is found that the steel having a component composition specified in the invention has a higher average r-value and more excellent workability than those in the comparative examples. In addition, the high temperature strength is also high and the oxidation resistance is also excellent. Since the comparative steels Nos. 14, 15, 17, 18, and 20 to 31 have a steel component which is out of the scope of the invention, the crystal orientation ratio of the product sheet is out of the scope of the invention, and thus the average r-value of the product sheet is in a range of less than 1.2. When these materials are subjected to working into a component having a complicated shape, there is a concern that cracking may occur. In addition, the comparative steels Nos. 16, 19, and 32 have a satisfactory r-value, but are insufficient in oxidation resistance and in high temperature strength. When these are applied as an exhaust component, there is a concern that breakage may occur during use.

Example 2

Next, with regard to the invention steels Nos. 1 and 6 shown in Table 1, characteristics of cases in which the manufacturing conditions were variously changed are shown in Table 3. The recrystallization state is a microstructure state in the region from t'/2 to t'/4.

TABLE 3

| Test No. | Steel No. | Hot Rolling: Heating Temperature (° C.) | Hot Rolling: Finishing Temperature (° C.) | Hot Rolling: Coiling Temperature (° C.) | Annealing of Hot Rolled Sheet: Heating Temperature (° C.) | Annealing of Hot Rolled Sheet: Recrystallization State After Annealing | Cold Rolling Rolling: Reduction Ratio (%) | Annealing of Cold Rolled Sheet: Heating Temperature (° C.) | |
|---|---|---|---|---|---|---|---|---|---|
| P33 | 1 | 1250 | 900 | 450 | 950 | Non-Recrystallized Microstructure | 60 | 1050 | Invention Example |
| P34 | 6 | 1260 | 910 | 460 | 970 | Non-Recrystallized Microstructure | 60 | 1070 | Invention Example |

TABLE 3-continued

| | | | | | | | | | |
|---|---|---|---|---|---|---|---|---|---|
| P35 | 1 | 1320 | 900 | 450 | 950 | Recrystallized Microstructure | 60 | 1050 | Comparative Example |
| P36 | 1 | 1240 | 1000 | 460 | 950 | Recrystallized Microstructure | 60 | 1070 | Comparative Example |
| P37 | 1 | 1230 | 900 | 600 | 940 | Non-Recrystallized Microstructure | 60 | 1020 | Comparative Example |
| P38 | 1 | 1250 | 920 | 450 | 1050 | Recrystallized Microstructure | 60 | 1020 | Comparative Example |
| P39 | 1 | 1250 | 880 | 470 | 950 | Non-Recrystallized Microstructure | 50 | 1050 | Comparative Example |
| P40 | 1 | 1240 | 880 | 430 | 950 | Non-Recrystallized Microstructure | 60 | 950 | Comparative Example |
| P41 | 6 | 1100 | 900 | 440 | 970 | Non-Recrystallized Microstructure | 60 | 1040 | Comparative Example (surface scratches was generated) |
| P42 | 6 | 1260 | 750 | 450 | 930 | Non-Recrystallized Microstructure | 60 | 1040 | Comparative Example (surface scratches was generated) |
| P43 | 6 | 1250 | 850 | 450 | 750 | Non-Recrystallized Microstructure | 60 | 1050 | Comparative Example |
| P44 | 6 | 1250 | 830 | 430 | 950 | Non-Recrystallized Microstructure | 60 | 1150 | Comparative Example |

| | | Crystal Orientation Ratio of Product Sheet | | | | |
|---|---|---|---|---|---|---|
| | | Ratio of {111}-Oriented Grains | | | | |
| Test No. | Steel No. | Surface Layer to t/4 (%) | t/4 to t/2 (%) | Ratio of {011}-Oriented Grains (%) | Product Sheet Average r-Value | |
| P33 | 1 | 22 | 48 | 8 | 1.3 | Invention Example |
| P34 | 6 | 26 | 56 | 7 | 1.6 | Invention Example |
| P35 | 1 | 22 | 35 | 17 | 1.1 | Comparative Example |
| P36 | 1 | 18 | 37 | 16 | 1.0 | Comparative Example |
| P37 | 1 | 21 | 39 | 16 | 1.1 | Comparative Example |
| P38 | 1 | 15 | 29 | 20 | 0.9 | Comparative Example |
| P39 | 1 | 8 | 15 | 14 | 0.7 | Comparative Example |
| P40 | 1 | 20 | 26 | 15 | 0.8 | Comparative Example |
| P41 | 6 | 22 | 45 | 15 | 1.2 | Comparative Example (surface scratches was generated) |
| P42 | 6 | 25 | 41 | 13 | 1.2 | Comparative Example (surface scratches was generated) |
| P43 | 6 | 15 | 42 | 22 | 0.9 | Comparative Example |
| P44 | 6 | 21 | 42 | 25 | 0.9 | Comparative Example |

It is found that test Nos. P33 and P34 in which all of the manufacturing conditions specified in the invention are satisfied have a higher average r-value and more excellent workability than those of the comparative examples.

It is found that in the comparative examples (test Nos. P35 to P44) which are out of the scope of the manufacturing conditions specified in the invention, the crystal orientation ratio of the product sheet is out of the scope of the invention, a satisfactory average r-value of 1.2 or greater is not obtained, and thus workability deteriorates. Therefore, when the product sheet is subjected to working into a component having a complicated shape, there is a concern that cracking may occur. In addition, when the heating temperature or the finishing temperature in the hot rolling is out of the lower limit, a satisfactory r-value of 1.2 or greater is obtained, but surface scratches are generated.

From these results, it was possible to confirm the above-described knowledge and also to support the evidence limiting the above-described steel compositions and configurations.

INDUSTRIAL APPLICABILITY

As is obvious from the above description, according to the invention, it is possible to efficiently provide a heat-resistant ferritic stainless steel sheet having excellent workability without requiring special new facilities. Therefore, when a cold rolled steel sheet to which the invention is applied is applied to, especially, an exhaust member, a social contribution ratio such as a reduction in manufacturing costs can be increased. That is, the invention has sufficient industrial applicability.

The invention claimed is:

1. A hot rolled ferritic stainless steel sheet for a material for cold rolling for manufacturing a heat-resistant cold rolled ferritic stainless steel sheet, the hot rolled ferritic stainless steel sheet consisting of, in terms of mass %, 0.02% or less of C, 0.1% to 1.0% of Si, greater than 0.6% to 1.5% of Mn, 0.01% to 0.05% of P,
0.0001% to 0.0100% of S,
13.0% to 20.0% of Cr,
0.1% to 3.0% of Mo,
0.05% to 0.20% of Ti,
0.30% to 1.0% of Nb,
0.0002% to 0.0050% of B,
0.005% to 0.45% of Al,
0.02% or less of N, and
the balance of Fe and inevitable impurities,
wherein a sheet thickness of the hot rolled ferritic stainless steel sheet is represented by t', and a microstructure of the hot rolled ferritic stainless steel sheet in a region from t'/2 to t'/4 is a non-recrystallized microstructure, and
with regard to a microstructure of the heat-resistant cold rolled ferritic stainless steel sheet, a sheet thickness of the heat-resistant cold rolled ferritic stainless steel sheet is represented by t, wherein {111}-oriented grains are present at an area ratio of 20% or greater in a region from a surface layer to t/4, {111}-oriented grains are present at an area ratio of 40% or greater in a region from t/4 to t/2, and {011}-oriented grains are present at an area ratio of 15% or less in the entire region in a thickness direction.

2. A hot rolled ferritic stainless steel sheet for a material for cold rolling for manufacturing a heat-resistant cold rolled ferritic stainless steel sheet,
the hot rolled ferritic stainless steel sheet consisting of, in terms of mass %,
0.02% or less of C,
0.1% to 1.0% of Si,
greater than 0.6% to 1.5% of Mn,
0.01% to 0.05% of P,
0.0001% to 0.0100% of S,
13.0% to 20.0% of Cr,
0.1% to 3.0% of Mo,
0.05% to 0.20% of Ti,
0.30% to 1.0% of Nb,
0.0002% to 0.0050% of B,
0.005% to 0.45% of Al,
0.02% or less of N,
one or more selected from the group consisting of 0.05% to 0.30% of Zr, 0.05% to 0.50% of Co, 0.4% to 2.0% of Cu, 0.1% to 2.0% of Ni, 0.1% to 3.0% of W, and 0.0002% to 0.0100% of Mg and
the balance of Fe and inevitable impurities,
wherein a sheet thickness of the hot rolled ferritic stainless steel sheet is represented by t', and a microstructure of the hot rolled ferritic stainless steel sheet in a region from t'/2 to t'/4 is a non-recrystallized microstructure, and
with regard to a microstructure of the heat-resistant cold rolled ferritic stainless steel sheet, a sheet thickness of the heat-resistant cold rolled ferritic stainless steel sheet is represented by t, wherein {111}-oriented grains are present at an area ratio of 20% or greater in a region from a surface layer to t/4, {111}-oriented grains are present at an area ratio of 40% or greater in a region from t/4 to t/2, and {011}-oriented grains are present at an area ratio of 15% or less in the entire region in a thickness direction.

* * * * *